US011328857B2

(12) United States Patent
Cao et al.

(10) Patent No.: US 11,328,857 B2
(45) Date of Patent: May 10, 2022

(54) HIGH-VOLTAGE ISOLATION WITHSTAND PLANAR TRANSFORMER AND HIGH-VOLTAGE INSULATION METHOD THEREOF

(71) Applicant: INSTITUTE OF ELECTRICAL ENGINEERING, CHINESE ACADEMY OF SCIENCES, Beijing (CN)

(72) Inventors: Guoen Cao, Beijing (CN); Yibo Wang, Beijing (CN); Yong Zhao, Beijing (CN); Jianhong Guo, Beijing (CN)

(73) Assignee: INSTITUTE OF ELECTRICAL ENGINEERING, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 17/482,502

(22) Filed: Sep. 23, 2021

(65) Prior Publication Data

US 2022/0028603 A1 Jan. 27, 2022

(30) Foreign Application Priority Data

Jul. 23, 2020 (CN) ..... 202010716068.5

(51) Int. Cl.
*H01F 5/00* (2006.01)
*H01F 27/32* (2006.01)
(Continued)

(52) U.S. Cl.
CPC ..... *H01F 27/324* (2013.01); *H01F 27/2804* (2013.01); *H01F 27/29* (2013.01);
(Continued)

(58) Field of Classification Search
CPC ..... H01F 27/2804
(Continued)

(56) References Cited

U.S. PATENT DOCUMENTS 7,460,002 B2 * 12/2008 Estrov ..... H01F 27/2847 336/200
10,490,342 B2 * 11/2019 Lu ..... H01F 27/40
(Continued)

FOREIGN PATENT DOCUMENTS

CN 102934178 A 2/2013
CN 203134536 U 8/2013
(Continued)

*Primary Examiner* — Ronald Hinson
(74) *Attorney, Agent, or Firm* — Bayramoglu Law Offices LLC

(57) ABSTRACT

A high-voltage isolation withstand planar transformer and its high-voltage insulation method are provided. An insulating medium is provided between low-voltage windings and high-voltage windings. High-frequency current flows through the windings and generates a high-frequency alternating magnetic field to achieve isolated energy transmission. The low-voltage windings are connected to low-voltage side connection terminals, and the high-voltage windings are connected to high-voltage side connection terminals through a high-voltage winding leading-out foil. An annular hollow part of the low-voltage windings and the high-voltage windings is provided with a magnetic core. A stress grading method is provided to control the distribution of the electric field around the high-voltage winding leading-out foil. A voltage-balancing element group provides a voltage potential with a gradient change between the high-voltage winding leading-out foil and the low-voltage windings. The new transformer has small size, high power density and low cost.

20 Claims, 4 Drawing Sheets

(51) Int. Cl.

| | |
|---|---|
| ***H01F 27/28*** | (2006.01) |
| ***H01F 27/29*** | (2006.01) |
| ***H01F 27/36*** | (2006.01) |
| ***H01F 30/06*** | (2006.01) |

(52) U.S. Cl.
CPC ..... *H01F 27/36* (2013.01); *H01F 30/06* (2013.01); *H01F 2027/2819* (2013.01)

(58) Field of Classification Search
USPC ..... 336/200
See application file for complete search history.

(56) References Cited

U.S. PATENT DOCUMENTS

| | | | | |
|---|---|---|---|---|
| 2013/0188329 | A1* | 7/2013 | Chang | H01F 27/2866<br>361/836 |
| 2014/0327511 | A1* | 11/2014 | Tsai | H01F 27/2847<br>336/220 |

FOREIGN PATENT DOCUMENTS

| | | | |
|---|---|---|---|
| CN | 206331886 | U | 7/2017 |
| CN | 110911126 | A | 3/2020 |
| CN | 112271065 | A | 1/2021 |
| DE | 2441091 | A1 | 3/1976 |
| JP | H0831663 | A | 2/1996 |

* cited by examiner

HIGH-VOLTAGE ISOLATION WITHSTAND PLANAR TRANSFORMER AND HIGH-VOLTAGE INSULATION METHOD THEREOF

CROSS REFERENCE TO THE RELATED APPLICATIONS

This application is based upon and claims priority to Chinese Patent Applications No. 202010716068.5, filed on Jul. 23, 2020, the entire contents of which are incorporated herein by reference.

TECHNICAL FIELD

The present invention belongs to the technical field of planar transformers, and more particularly, relates to a high-voltage isolation withstand planar transformer and a high-voltage insulation method thereof.

BACKGROUND

In recent years, power electronic transformer (PET) has received growing attention due to a series of functional advantages such as alternating current (AC)/direct current (DC) conversion, electrical isolation, power regulation and control. In electric locomotive traction, AC/DC hybrid distribution grid, DC grid-connected renewable energy power generation, electric vehicle fast charging station, data center power supply and other fields, PETs can significantly improve system performance, efficiency and reliability, and thus have great application potential.

Among PETs, high power, high insulation voltage and high frequency transformer is the core component of isolated DC/DC converters for achieving high-voltage and low-voltage electrical isolation, voltage conversion, power transmission and other core functions. The conversion efficiency, power density and reliability of high-frequency transformers are critical to the safe, stable and efficient operation of the PET systems. With the deepening of the application of power electronic transformers in medium-voltage and high-voltage AC and DC grids, the application requirements of high isolation voltage, high efficiency, high power density and high reliability are put forward for high-frequency transformers, aiming to comprehensively improve the economy and applicability of the system.

In terms of structure, traditional high-voltage isolation transformers are usually assembled by winding copper coils on a magnetic core. They generally have a large volume, and the related parasitic parameters are hard to control, which makes it hard to ensure the consistency of product parameters during production, thereby bringing great challenges to the voltage and current equalizing control of modular converters. In terms of insulation design, traditional insulation methods such as epoxy potting and transformer oil immersion are usually adopted to achieve the main insulation between the high-voltage and low-voltage windings. However, in most applications, the design for the grounding of the magnetic core and the insulation of the leading-out terminal is rarely considered in the transformers. Although the isolation withstand voltage between the high-voltage and low-voltage windings can be achieved, the high-voltage insulation problem is actually transferred to the system design, resulting in a whole large size of the system, which severely restricts its application.

In terms of insulation design of the leading-out terminal of the high-voltage isolation transformer, generally, the insulation gap is increased or a high-voltage cable terminal is directly used. Increasing the insulation gap, however, will further increase the size of the transformer and cannot solve the problem of electric field stress concentration at the terminals. The high-voltage cable terminal usually adopts a stress cone structure or is clad by a material with a high dielectric constant to control the electric field stress at the cable terminal. These two methods have disadvantages such as large size, complex structure, high process condition requirements, and cannot be directly applied to the design of leading-out terminals of high-frequency transformers.

Planar transformers have a new structural form for high-frequency transformers. They have a planar structure, and include an EI type, RM-type or other planar magnetic core, and windings that are usually copper foils or PCB wingdings stacked together. Planar transformers are greatly reduced in height in comparison with conventional transformers. Due to the limitation of the number of turns, they are usually used in low-power (≤3 kW) applications with higher frequencies (≥100 kHz). Due to the small size and compact structure of the planar transformer, the insulation distance between the primary and secondary windings is limited, and it is currently mainly found in applications with a low isolation voltage (≤4 kV).

In general, it is desirable in the art to develop a high-voltage isolation withstand planar transformer that can be used in occasions with high isolation withstand voltage requirements.

SUMMARY

In order to solve the above-mentioned problems in the prior art, that is, the traditional transformer is bulky and the prior planar transformer cannot be applied to occasions with high isolation withstand voltage requirements, the present invention provides a novel high-voltage isolation planar transformer. The transformer is comprised of low-voltage side connection terminals, low-voltage windings, high-voltage windings, a high-voltage winding leading-out foil, high-voltage side connection terminals, an insulating medium, a magnetic core, a printed circuit board (PCB) stress grading unit, a voltage-balancing element group, and stress control bars, where the low-voltage side connection terminals are configured to connect the transformer and an external low-voltage circuit;

the low-voltage windings are connected to the low-voltage side connection terminal; and the high-voltage windings are connected to the high-voltage side connection terminal through the high-voltage winding leading-out foil;

the high-voltage side connection terminals are configured to connect the transformer and an external high-voltage circuit;

the insulating medium is configured for high-voltage isolation between the low-voltage and the high-voltage windings;

the magnetic core passes through an annular hollow part of the low-voltage and high-voltage windings to form a closed magnetic loop;

the PCB stress grading unit is configured to control the distribution of an electric field around the high-voltage winding leading-out foil and reduce an electric field strength in air; and the voltage-balancing group includes a plurality of voltage-balancing elements and is configured to provide a voltage potential with a gradient change, where the plurality of voltage-balancing element are uniformly distributed through the stress control bars and sequentially connected in series between the high-voltage winding leading-out foil and the low-voltage windings.

In some preferred embodiments, the low-voltage windings and the high-voltage windings may be inner-layer copper foils of a multilayer PCB; the low-voltage windings may be distributed on upper and lower layers of the high-voltage windings; and the width of the low-voltage windings may completely cover that of the high-voltage windings.

In some preferred embodiments, the voltage-balancing elements in the voltage-balancing group may be sequentially connected in series via the stress control bars; the stress control bars may be a plurality of wires in a multilayer PCB; the stress control bars may have the voltage potential with the gradient change; and the voltage potential may gradually decrease from the high-voltage winding leading-out foil to the low-voltage windings in the form of gradient.

In some preferred embodiments, the voltage-balancing elements may be resistors or capacitors.

In some preferred embodiments, the voltage-balancing elements may be welded to an outer layer of the multilayer PCB or embedded in an inner layer of the multilayer PCB.

In some preferred embodiments, the high-voltage winding leading-out foil and the stress control bars may be connected through buried vias, blind vias or through vias; and the voltage-balancing elements corresponding to the connected wires of the stress control bars have an identical voltage potential.

In some preferred embodiments, the insulating medium may include an FR-4 substrate with a high dielectric breakdown field strength and a prepreg.

In some preferred embodiments, the low-voltage windings have a multilayer structure, in which various layers may be connected through buried vias; the high-voltage windings have a single-layer structure or have a multilayer structure, in which various layers may be connected through buried vias.

In some preferred embodiments, the magnetic core may be connected to a reference ground of the low-voltage windings through a conductor.

Another aspect of the present invention provides a high-voltage insulation method of a high-voltage isolation withstand planar transformer. Based on the above-mentioned high-voltage isolation withstand planar transformer, the method includes:

step S10: determining the material and thickness of an insulating medium of a PCB substrate according to a breakdown voltage, a dielectric constant, a loss factor, a thermal conductivity and a glass transition temperature (Tg) of the insulating medium; and determining the material and thickness of an insulating medium of a PCB prepreg according to a gel time and a resin content;

step S20: obtaining a working condition of the high-voltage isolation withstand planar transformer, and determining, based on the working condition, maximum design electric field strengths of the PCB insulating medium and air as electric field strength thresholds;

step S30: determining a routing shape, a via hole form, a pad shape, a copper foil size and a winding stacking mode of the PCB according to a primary voltage, a secondary voltage, a rated power and an insulation withstand voltage of the transformer, and determining the structure and number of the stress control bars and the voltage-balancing elements in the PCB stress grading unit;

step S40: obtaining electric field strengths of the PCB insulating medium and air through calculation, simulation or testing based on the thickness of the insulating medium, the structure and number of the voltage-balancing elements and the copper foil size of the PCB; and step S50: returning, if the electric field strengths are greater than the electric field strength thresholds, to step S10 for iterative design until the electric field strengths are less than the electric field strength thresholds, to obtain high-voltage insulation parameters of the high-voltage isolation withstand planar transformer.

The present invention has the following advantages:

(1) In the present invention, a planar transformer structure is adopted, and the high-voltage windings and the low-voltage windings are achieved by a plurality of layers of copper foils in the PCB. The planar transformer has a high power density, and thanks to the high processing accuracy of the PCB, the parameters of the PCB windings based planar transformer have high consistency.

(2) In the present invention, the low-voltage windings are stacked with the high-voltage windings, and the low-voltage windings completely cover the high-voltage windings, which reduces the electric field strength in air around the high-voltage windings. In addition, the high-voltage solid insulation between the high-voltage and low-voltage windings is achieved through the PCB insulating medium, which reduces the possibility of partial discharge in air.

(3) In the present invention, the low-voltage windings and the high-voltage windings are stacked and the low-voltage windings are located on the outside, which facilitates grounding of the magnetic core of the transformer and avoids electromagnetic interference of the high-voltage electric field on the magnetic core.

(4) In the present invention, the PCB stress grading unit wraps the high-voltage winding leading-out foil and controls the distribution of the electric field around the high-voltage winding leading-out foil, which reduces the electric field strength in air and reduces the possibility of partial discharge in air. Compared with the conventional structure that increases the insulation gap or adopts a high-voltage cable terminal, the present invention greatly reduces the size, simplifies the structure, and improves the power density of the transformer.

(5) The present invention makes full use of the excellent and mature processing technology of the PCB and the PCB insulating medium, and the proposed PCB windings have a simple structure and low processing and manufacturing costs.

BRIEF DESCRIPTION OF THE DRAWINGS

Other features, objectives and advantages of the present invention will become more apparent upon reading the detailed description of the non-restrictive embodiments with reference to the following drawings.

DETAILED DESCRIPTION OF THE EMBODIMENTS

Figure 1:
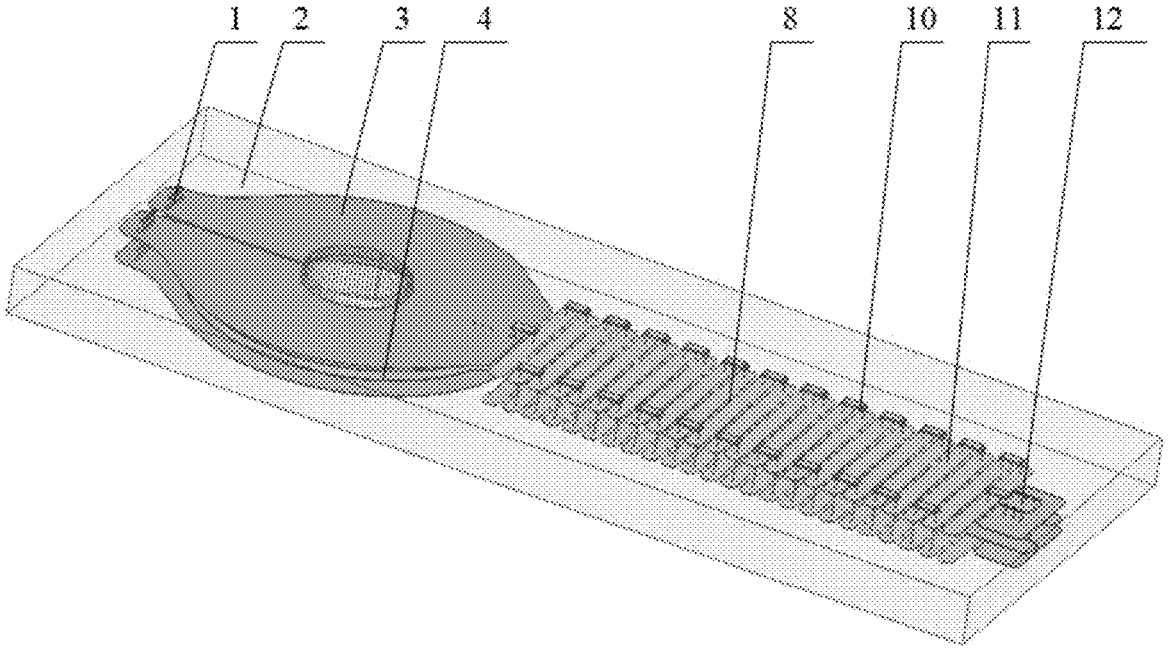
FIG. 1 shows a three-dimensional (3D) view of a high-voltage isolation withstand planar transformer according to an embodiment of the present invention.

The present invention will be further described in detail below in conjunction with the drawings and embodiments. It may be understood that the specific embodiments described herein are merely intended to explain the present invention, rather than to limit the present invention. It should also be noted that, for convenience of description, only the parts related to the present invention are shown in the drawings.

It should be noted that the embodiments in the present invention and features in the embodiments may be combined with each other if no conflict occurs. The present invention will be described in detail below with reference to the drawings and embodiments.

The present invention provides a high-voltage isolation withstand planar transformer. The transformer includes a low-voltage side connection terminal, low-voltage windings, high-voltage windings, a high-voltage winding leading-out foil, a high-voltage side connection terminal, an insulating medium, a magnetic core, a printed circuit board (PCB) stress grading unit, a voltage-balancing element group, and stress control bars.

The low-voltage side connection terminal is configured to connect the transformer and an external low-voltage circuit.

The low-voltage windings are connected to the low-voltage side connection terminal; and the high-voltage windings are connected to the high-voltage side connection terminal through the high-voltage winding leading-out foil.

The high-voltage side connection terminal is configured to connect the transformer and an external high-voltage circuit.

The insulating medium is configured for high-voltage isolation between the low-voltage windings and the high-voltage windings.

The magnetic core passes through an annular hollow part of the low-voltage windings and the high-voltage windings to form a closed magnetic circuit.

The PCB stress grading unit is configured to control the distribution of an electric field around the high-voltage winding leading-out foil and reduce an electric field strength in air.

The voltage-balancing element group includes a plurality of voltage-balancing elements and is configured to provide a voltage potential with a gradient change, where the plurality of voltage-balancing element are uniformly distributed through the stress control bars and sequentially connected in series between the high-voltage winding leading-out foil and the low-voltage windings.

In order to describe the high-voltage isolation withstand planar transformer provided by the present invention more clearly, various modules in the embodiment of the present invention are described in detail below with reference to FIGS. 2 and 3.

An embodiment of the present invention provides a high-voltage isolation withstand planar transformer. The transformer includes a low-voltage side connection terminal 1, low-voltage windings 3, high-voltage windings 4, a high-voltage winding leading-out foil 8, a high-voltage side connection terminal 12, an insulating medium 2, a magnetic core 5, a PCB stress grading unit 6, a voltage-balancing element group 10 and stress control bars 11. These modules are described in detail below.

The low-voltage side connection terminal 1 is configured to connect the transformer and an external low-voltage circuit.

The low-voltage side connection terminal of the transformer is connected to the external low-voltage circuit to receive a low voltage from the external low-voltage circuit or provide a low voltage for the external low-voltage circuit.

The low-voltage windings 3 are connected to the low-voltage side connection terminal 1, and the high-voltage windings 4 are connected to the high-voltage side connection terminal 12 through the high-voltage winding leading-out foil 8.

A high-frequency current flows in the low-voltage windings and the high-voltage windings in the form of a high-frequency alternating magnetic field to achieve isolated transmission of electric energy.

The low-voltage windings and the high-voltage windings are inner-layer copper foils of a multilayer PCB. The low-voltage windings are distributed on upper and lower layers of the high-voltage windings. The width of the low-voltage windings completely covers the width of the high-voltage windings.

The low-voltage windings have a multilayer structure, in which various layers are connected through buried vias, the high-voltage windings have a single-layer structure or have a multilayer structure, in which various layers are connected through buried vias.

The high-voltage side connection terminal 12 is configured to connect the transformer and an external high-voltage circuit.

The high-voltage side connection terminal of the transformer is connected to the external high-voltage circuit to receive a high voltage from the external high-voltage circuit or provide a high voltage for the external high-voltage circuit.

The insulating medium 2 is configured for high-voltage isolation between the low-voltage windings and the high-voltage windings.

The insulating medium includes an FR-4 substrate with a high dielectric breakdown field strength and a prepreg. The typical breakdown field strengths of some common FR-4 substrates and air are shown in Table 1:

TABLE 1

| Name of medium | Typical breakdown field strength (kV/mm) | Maximum design field strength (kV/mm) |
|---|---|---|
| FR-4 epoxy resin (S0165) | 55 | 27.5 |
| FR-4 epoxy resin (S1180) | 60 | 30 |
| FR-4 epoxy resin (S1170) | 62 | 31 |
| Air (0.1 MPa/25° C.) | 3 | 2 |

In an embodiment of the present invention, the insulating medium is made of FR-4 epoxy resin (S1180).

The magnetic core 5 passes through an annular hollow part of the low-voltage windings and the high-voltage windings to form a closed magnetic circuit. The magnetic core can provide a path with a small magnetic resistance, which improves magnetic induction in the magnetic circuit, and reduces the winding loss. The magnetic core is connected to a reference ground of the low-voltage windings through a conductor, so there is no need for insulation between the magnetic core of the transformer and the low-voltage windings.

The PCB stress grading unit 6 is configured to control the distribution of an electric field around the high-voltage winding leading-out foil and reduce an electric field strength in air.

The voltage-balancing element group 10 includes a plurality of voltage-balancing elements uniformly distributed through the stress control bars 11 and sequentially connected in series between the high-voltage winding leading-out foil and the low-voltage windings, and is configured to provide a voltage potential with a gradient change. The voltage potential gradually decreases from the high-voltage winding leading-out foil to the low-voltage windings in the form of gradient.

Figure 2:
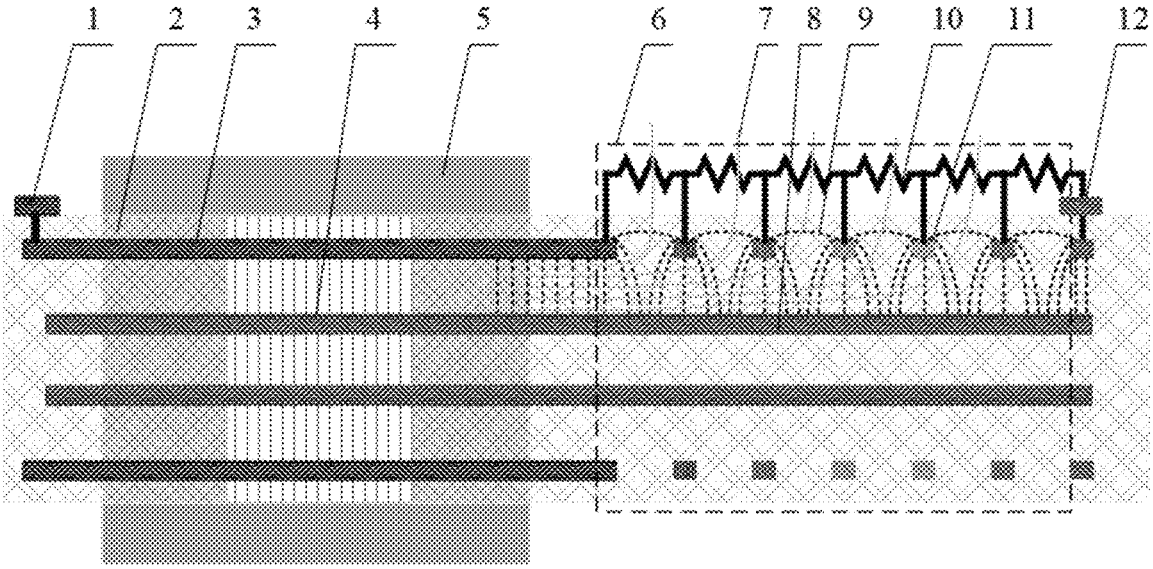
FIG. 2 shows a high-voltage isolation withstand planar transformer using surface-mounted voltage-balancing elements and an electric field analysis thereof according to an embodiment of the present invention.
Figure 3:
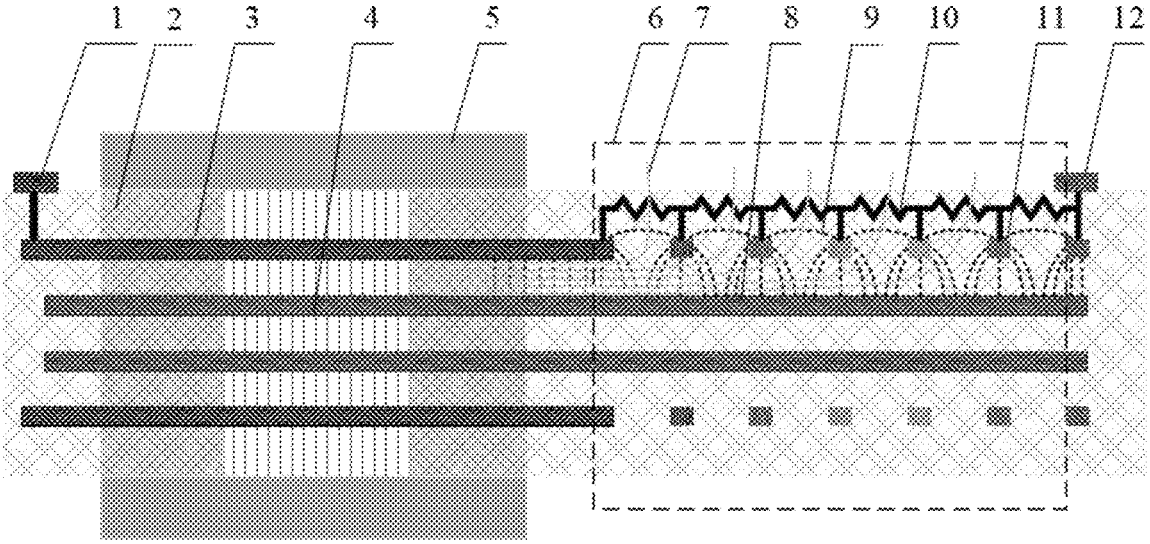
FIG. 3 shows a high-voltage isolation withstand planar transformer using embedded voltage-balancing elements and an electric field analysis thereof according to an embodiment of the present invention.
Figure 4:
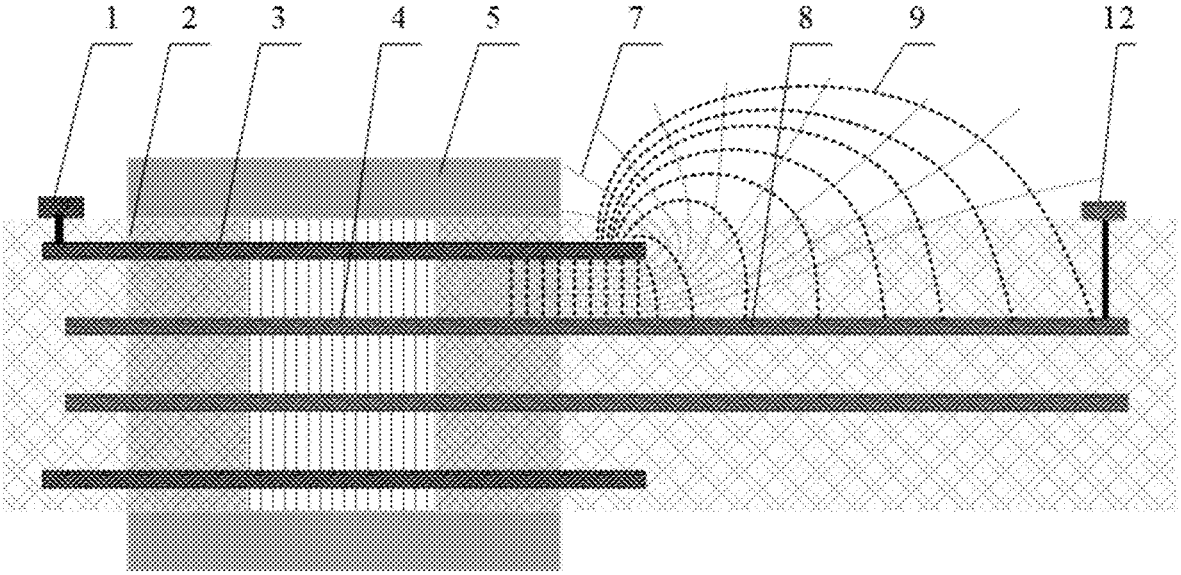
FIG. 4 (Prior art)
FIG. 4 shows a common planar transformer and an electric field analysis thereof.

As shown in FIGS. 2 and 3, embodiments of the present invention respectively provide a high-voltage isolation withstand planar transformer using surface-mounted voltage-balancing elements and an electric field analysis thereof and a high-voltage isolation withstand planar transformer using embedded voltage-balancing elements and an electric field analysis thereof. The transformer includes a low-voltage side connection terminal 1, an insulating medium 2, low-voltage windings 3, high-voltage windings 4, a magnetic core 5, a PCB stress grading unit 6, an equipotential line 7, a high-voltage winding leading-out foil 8, an electric field strength line 9, a voltage-balancing element group 10, stress control bars 11 and a high-voltage side connection terminal 12. FIG. 4 shows a common planar transformer and an electric field analysis thereof. The transformer includes a low-voltage side connection terminal 1, an insulating medium 2, low-voltage windings 3, high-voltage windings 4, a magnetic core 5, an equipotential line 7, a high-voltage winding leading-out foil 8, an electric field strength line 9 and a high-voltage side connection terminal 12. To facilitate the analysis, FIGS. 2 to 4 only show edges of the high-voltage and low-voltage windings in an upper part of the PCB and the electric field distribution and voltage potential distribution at the high-voltage winding leading-out foil.

In inner layers of the PCB, the low-voltage windings and the high-voltage windings are parallel and stacked. The low-voltage windings may be regarded as continuous shielding layers of the high-voltage windings (5-50 kV). Ignoring the edges of the winding copper foils, as shown in FIG. 4, the electric field may be regarded as uniformly distributed in a direction parallel to the high-voltage and low-voltage windings, and the voltage potential gradually decreases in a direction perpendicular to the windings. Since the insulating medium is provided between the high-voltage and low-voltage windings, a high-voltage electric field is applied to the insulating medium. The breakdown field strength of the insulating medium is much greater than that of air, so the windings of the PCB can withstand a higher voltage.

However, as shown in FIG. 4, due to the sudden disconnection of the high-voltage and low-voltage windings in the direction parallel to the PCB, the distribution of the electric field at the edges of the windings is no longer uniform, causing the electric field strength to concentrate on the edges of the windings. With the increase of the voltage applied between the high-voltage and low-voltage windings, a higher electric field strength is likely to cause partial discharge or even breakdown in air on the surface of the PCB, leading to insulation failures, etc.

In order to solve the above-mentioned problem, the present invention proposes a method of increasing the width of the low-voltage windings such that the width of the low-voltage windings completely covers the width of the high-voltage windings, that is, the low-voltage windings are wider than the high-voltage windings by a set distance. The increased width of the low-voltage windings should be specifically determined in consideration of various factors such as the thickness and actual working conditions of the PCB, which will not be described in detail here. As shown in FIGS. 2 and 3, while the low-voltage windings completely cover the high-voltage windings, the low-voltage windings are slightly wider than the high-voltage windings, which completely shields the high-voltage windings and reduces the electric field in air at the edges of the low-voltage windings. Meanwhile, the insulation part of the PCB is widened such that the concentrated electric field is applied to the PCB insulating medium. Since the breakdown field strength of the PCB insulating medium is much greater than that of air, the field strength in air can be reduced and partial discharge in air can be avoided.

The high-voltage windings are not disconnected at the high-voltage winding leading-out foil, but the disconnection of the low-voltage windings also causes electric field concentration, which can easily cause insulation problems such as partial discharge.

In order to solve the above-mentioned problem, the present invention adds a PCB stress grading unit to the high-voltage isolation withstand planar transformer. As shown in FIGS. 2 and 3, a plurality of copper foils are uniformly distributed between the high-voltage side terminal and the low-voltage windings as stress control bars. The voltage is equalized by high-voltage resistors, capacitors and other elements, such that each of the stress control bars has a fixed voltage potential that changes step by step. In this way, a uniformly distributed electric field is formed between the high-voltage side terminals and the low-voltage windings. In addition, because the stress control bars are distributed on the upper and lower layers of high-voltage winding lead wires and completely cover them, they can play a role in electric field shielding. The voltage-balancing elements in the PCB stress grading unit may be conventional resistors or capacitors soldered on the surface of the PCB, as shown in FIG. 2. Alternatively, they may also be resistors or capacitors processed by a special process and embedded in the PCB, as shown in FIG. 3. The stress control bars on the upper and the lower layers are respectively connected through buried vias or blind vias, such that the upper and lower sides of the high-voltage winding lead wires have uniformly distributed electric fields. This avoids excessive electric field strengths in air and in the PCB insulating medium at the disconnection of the low-voltage windings, and avoids problems such as partial discharge and breakdown.

A conventional insulation design increases the insulation gap or adopts a high-voltage cable terminal structure. In contrast, the PCB stress grading unit proposed by the present invention is greatly reduced in size, thereby increasing the power density of the transformer.

In order to reduce the electric field concentration caused by the sharp part of the PCB via, the present invention arranges the low-voltage windings and the high-voltage windings on the inner layers of the PCB, and the winding layers are connected through buried vias. Therefore, no transformer winding is provided on first and N-th layers of an N-layer PCB, and the low-voltage windings are provided on second and (N−1)-th layers of the N-layer PCB. The low-voltage windings and the PCB stress grading unit together wrap the high-voltage windings and the high-voltage winding lead wires inside the PCB, which solves the problem of electric field concentration in air. Meanwhile, the magnetic core of the transformer based on this structure may also be connected to a reference ground of the low-voltage windings through a conductor. There is no insulation problem between the magnetic core of the transformer and the low-voltage windings, which ensures the reliable operation of the planar transformer.

A second embodiment of the present invention provides a high-voltage insulation method of a high-voltage isolation withstand planar transformer. Based on the above-mentioned high-voltage isolation withstand planar transformer, the method includes:

Step S10: Determine the material and thickness of an insulating medium of a PCB substrate according to a breakdown voltage, a dielectric constant, a loss factor, a thermal conductivity and a glass transition temperature (Tg) of the insulating medium; and determine the material and thickness of an insulating medium of a PCB prepreg according to a gel time and a resin content.

According to the breakdown voltage, the dielectric constant, the loss factor, the thermal conductivity and the Tg value of the insulating medium, the material of the FR-4 substrate of the PCB is determined. According to parameters such as the gel time and the resin content, the PCB prepreg is selected and the thickness of the FR-4 substrate and the prepreg is determined.

In an embodiment of the present invention, the PCB substrate is made of FR-4 epoxy resin S1180, which has a typical breakdown field strength of 60 kV/mm.

Step S20: Obtain a working condition of the high-voltage isolation withstand planar transformer, and determine, based on the working condition, maximum design electric field strengths of the PCB insulating medium and air as electric field strength thresholds.

In an embodiment of the present invention, half of the typical breakdown field strength of the S1180 medium, that is, 30 kV/mm, is used as the electric field strength threshold, and the electric field strength threshold of air is set to 2 kV/mm.

Step S30: Determine a via hole form, a pad shape, a copper foil size and a winding stacking mode of the PCB according to a primary voltage, a secondary voltage, a rated power and an insulation withstand voltage of the transformer, and determine the structure and number of the stress control bars and the voltage-balancing elements in the PCB stress grading unit.

According to the electrical parameters of the transformer, the number of layers of the PCB and the stacked structure of the high-voltage and low-voltage windings are set. In order to alleviate the electric field concentration in air on the surface of the PCB, the geometric shapes of the surface traces, copper foils, pads and vias are set. According to the insulation voltage between the high-voltage and low-voltage windings, the number of stress control bars in the PCB stress grading unit and the withstand voltage, packaging, number and other parameters of the voltage-balancing elements are set. In an embodiment of the present invention, the number of the stress control bars is set to 24. The voltage-balancing elements are high-voltage resistors with a withstand voltage of 3 kV. The insulation withstand voltage between the high-voltage and low-voltage windings is set to 50 kV.

Step S40: Obtain electric field strengths of the PCB insulating medium and air through calculation, simulation or testing based on the thickness of the insulating medium, the structure and number of the voltage-balancing elements and the copper foil size of the PCB.

Step S50: Return, if the electric field strengths are greater than the electric field strength thresholds, to step S10 for iterative design until the electric field strengths are less than the electric field strength thresholds, to obtain high-voltage insulation parameters of the high-voltage isolation withstand planar transformer.

Figure 5:
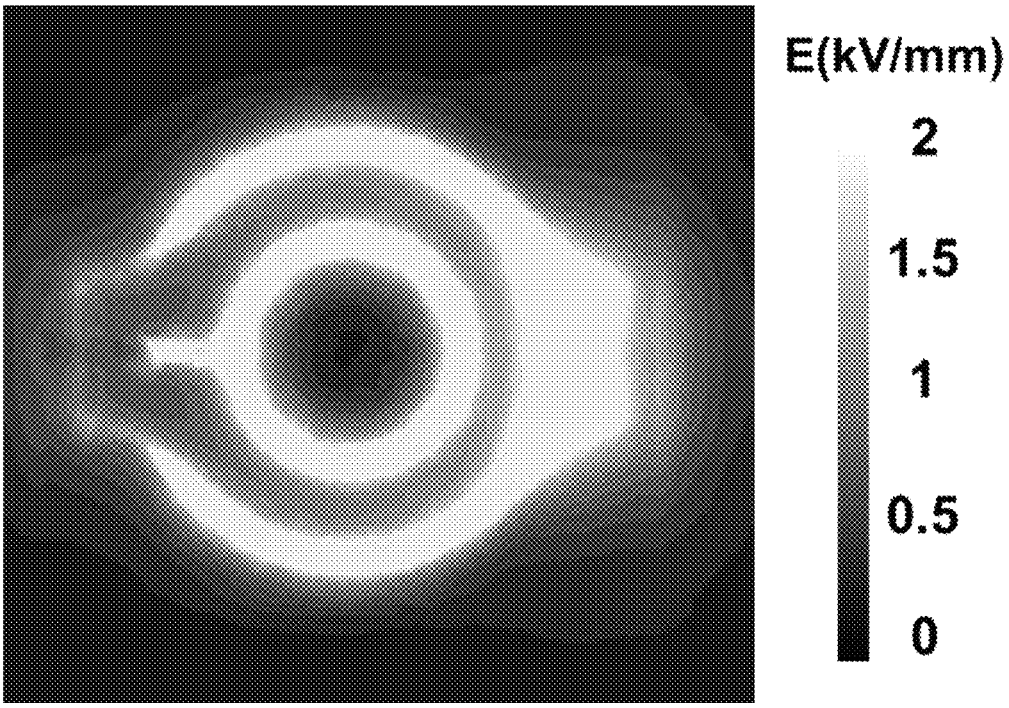
FIG. 5 shows a finite element analysis (FEA) result of an electric field strength in air for a high-voltage isolation withstand planar transformer in which low-voltage and high-voltage windings have an identical width according to an embodiment of the present invention.
Figure 6:
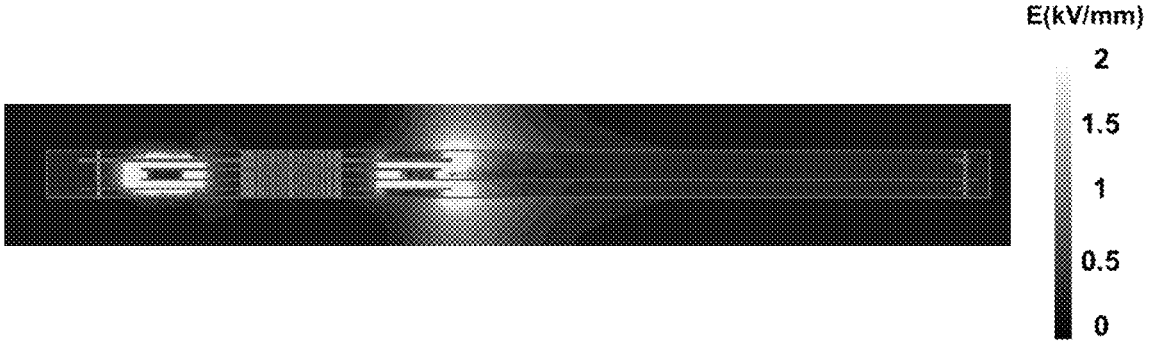
FIG. 6 is a side view showing an FEA result of an electric field strength in air for a high-voltage isolation withstand planar transformer in which a low-voltage winding is wider than a high-voltage winding according to an embodiment of the present invention.
Figure 7:
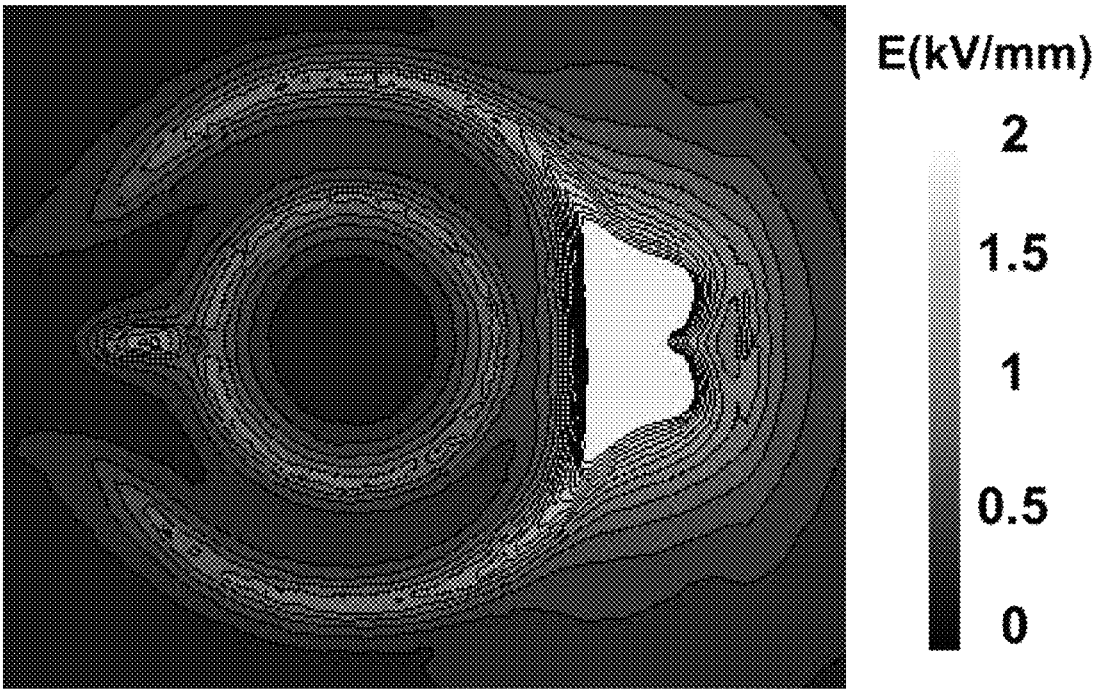
FIG. 7 shows an FEA result of a high-voltage isolation withstand planar transformer which is not provided with a printed circuit board (PCB) stress grading unit according to an embodiment of the present invention.

In an embodiment of the present invention, the electric field strengths in the PCB insulating medium and air are obtained through finite element analysis (FEA). FIG. 1 shows a three-dimensional (3D) view of the high-voltage isolation withstand planar transformer according to an embodiment of the present invention. The PCB adopts a 6-layer structure, with low-voltage windings distributed on second and fifth layers and high-voltage windings on third and fourth layers. The low-voltage windings and the high-voltage windings have an identical width. An FEA result on the electric field strength of air and a side view of the simulation result are shown in FIGS. 5 and 6, respectively. It can be seen that although the low-voltage windings cover the upper and lower layers of the high-voltage windings, the electric field strength in air is far more than 2 kV/mm due to the electric field concentration along the winding edges. The width of the low-voltage windings is 2 mm greater than that of the high-voltage windings, and the FEA result on the field strength of air is shown in FIG. 7. It can be seen that the electric field strength in air at the edges of the high-voltage and low-voltage windings is reduced to <1.5 kV/mm.

Figure 8:
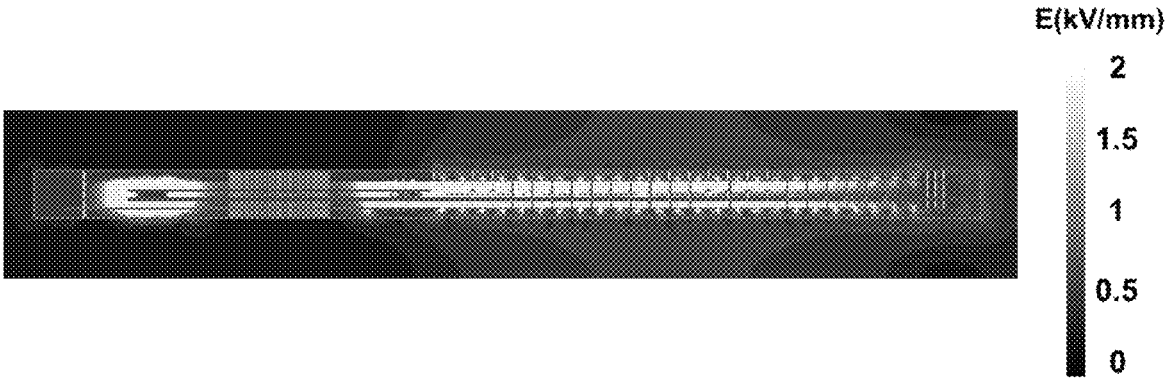
FIG. 8 shows an FEA result of a high-voltage isolation withstand planar transformer which is provided with a PCB stress grading unit according to an embodiment of the present invention.

However, even if the width of the low-voltage windings is 2 mm greater than that of the high-voltage windings, the electric field at the high-voltage winding leading-out foil and the disconnection of the low-voltage windings is still very concentrated, and the electric field strength in air is much greater than the set electric field strength threshold. To solve this problem, the present invention adds a PCB stress grading unit to the high-voltage isolation withstand planar transformer. A side view of an FEA result on the electric field strength of air of the transformer is shown in FIG. 8. It can be seen that the electric field strength of air at the disconnection of the low-voltage windings is reduced to <1.5 kV/mm. In addition, the electric field strength inside the PCB is uniformly distributed from the high-voltage side terminals to the low-voltage windings, and the maximum electric field strength of the PCB insulating medium is 24 kV/mm.

In summary, the high-voltage windings are provided in between the low-voltage windings and the width of the low-voltage windings is 2 mm greater than that of the high-voltage windings. FEA results show that, by adding the PCB stress grading unit at the high-voltage winding leading-out foil, the electric field strength of air at the edges of the high-voltage and low-voltage windings is less than 1.5 kV/mm, and the electric field strength of air at the high-voltage winding leading-out foil (or at the disconnection of the low-voltage windings) is less than 1.5 kV/mm. In addition, the electric field strength inside the PCB is uniformly distributed from the high-voltage side terminals to the low-voltage windings, and the maximum electric field strength in the PCB insulating medium is 24 kV/mm. These electric field strengths meet the design electric field strength thresholds (not greater than 30 kV/mm inside the PCB, and not greater than 2 kV/mm in air).

Those skilled in the art should clearly understand that, for convenience and brevity of description, reference is made to corresponding processes in the above-mentioned method embodiments for specific working processes and related description of the system, and details are not described herein again.

It should be noted that the high-voltage insulation method of the high-voltage isolation withstand planar transformer provided by the above-mentioned embodiments is only described by taking the division of the above-mentioned functional modules as an example. In practical applications, the above-mentioned functions can be completed by different functional modules as required, that is, the modules or steps in the embodiments of the present invention are further decomposed or combined. For example, the modules of the above-mentioned embodiments may be combined into one module, or may be further divided into a plurality of sub-modules to complete all or part of the functions described above. The names of the modules and steps involved in the embodiments of the present invention are only for distinguishing each module or step, and should not be regarded as improper limitations on the present invention.

A third embodiment of the present invention proposes a storage device. The storage device stores a plurality of programs, which are suitable for being loaded and executed by a processor to implement the above-mentioned high-voltage insulation method of the high-voltage isolation withstand planar transformer.

A fourth embodiment of the present invention provides a processing device. The processing device includes a processor and a storage device. The processor is suitable for executing a plurality of programs. The storage device is suitable for storing the plurality of programs. These programs are suitable for being loaded and executed by the processor to implement the above-mentioned high-voltage insulation method of the high-voltage isolation withstand planar transformer.

Those skilled in the art should clearly understand that, for convenience and brevity of description, reference is made to corresponding processes in the above-mentioned method embodiments for specific working processes and related description of the storage device and processing device, and details are not described herein again.

Those skilled in the art should be aware that the modules and method steps of the examples described in the embodiments disclosed herein may be implemented by electronic hardware, computer software or a combination thereof. The programs corresponding to software modules and method steps may be placed in random access memory (RAM), internal memory, read-only memory (ROM), electrically programmable ROM, electrically erasable programmable (ROM), registers, hard disk, removable disk, compact disc read-only memory (CD-ROM), or in any other form of storage medium known in the technical field. In order to clearly illustrate the interchangeability of THE electronic hardware and software, the composition and steps of each example are generally described in accordance with the function in the above-mentioned description. Whether the functions are performed by hardware or software depends on particular applications and design constraint conditions of the technical solutions. Those skilled in the art may use different methods to implement the described functions for each specific application, but such implementation should not be considered to be beyond the scope of the present invention.

Terms such as "first" and "second" are intended to distinguish between similar objects, rather than to necessarily describe or indicate a specific order or sequence.

In addition, terms "include", "comprise" or any other variations thereof are intended to cover non-exclusive inclusions, so that a process, a method, an article, or a device/apparatus including a series of elements not only includes those elements, but also includes other elements that are not explicitly listed, or also includes inherent elements of the process, the method, the article or the device/apparatus.

The technical solutions of the present invention are described with reference to the preferred implementations and drawings. Those skilled in the art should easily understand that the protection scope of the present invention is apparently not limited to these specific implementations. Those skilled in the art can make equivalent changes or substitutions to the relevant technical features without departing from the principles of the present invention, and the technical solutions after these changes or substitutions should fall within the protection scope of the present invention.

What is claimed is:

1. A high-voltage isolation withstand planar transformer, comprising a low-voltage side connection terminal, low-voltage windings, high-voltage windings, a high-voltage winding leading-out foil, a high-voltage side connection terminal, an insulating medium, a magnetic core, a printed circuit board (PCB) stress grading unit, a voltage-balancing element group, and stress control bars, wherein the low-voltage side connection terminal is configured to connect the high-voltage isolation withstand planar transformer and an external low-voltage circuit;

the low-voltage windings are connected to the low-voltage side connection terminal;

the high-voltage windings are connected to the high-voltage side connection terminal through the high-voltage winding leading-out foil;

the high-voltage side connection terminal is configured to connect the high-voltage isolation withstand planar transformer and an external high-voltage circuit;

the insulating medium is configured for high-voltage isolation between the low-voltage windings and the high-voltage windings;

the magnetic core passes through an annular hollow part of the low-voltage windings and the high-voltage windings to form a closed magnetic circuit;

the PCB stress grading unit is configured to control a distribution of an electric field around the high-voltage winding leading-out foil and reduce an electric field strength in air; and the voltage-balancing element group comprises a plurality of voltage-balancing elements and is configured to provide a voltage potential with a gradient change, wherein the plurality of voltage-balancing elements are uniformly distributed through the stress control bars and sequentially connected in series between the high-voltage winding leading-out foil and the low-voltage windings.

2. The high-voltage isolation withstand planar transformer according to claim 1, wherein the plurality of voltage-balancing elements are resistors or capacitors.

3. The high-voltage isolation withstand planar transformer according to claim 1, wherein the insulating medium comprises an FR-4 substrate with a high dielectric breakdown field strength and a prepreg.

4. The high-voltage isolation withstand planar transformer according to claim 1, wherein the low-voltage windings have a multilayer structure, in which various layers are connected through buried vias; the high-voltage windings have a single-layer structure or have a multilayer structure, in which various layers are connected through buried vias.

5. The high-voltage isolation withstand planar transformer according to claim 1, wherein the magnetic core is connected to a reference ground of the low-voltage windings through a conductor.

6. The high-voltage isolation withstand planar transformer according to claim 1, wherein the low-voltage windings and the high-voltage windings are inner-layer copper foils of a multilayer PCB; the low-voltage windings are distributed on upper and lower layers of the high-voltage windings; and a width of the low-voltage windings completely covers a width of the high-voltage windings.

7. The high-voltage isolation withstand planar transformer according to claim 6, wherein the low-voltage windings have a multilayer structure, in which various layers are connected through buried vias; the high-voltage windings have a single-layer structure or have a multilayer structure, in which various layers are connected through buried vias.

8. The high-voltage isolation withstand planar transformer according to claim 1, wherein the plurality of voltage-balancing elements in the voltage-balancing element group are sequentially connected in series via the stress control bars; the stress control bars are a plurality of wires in a multilayer PCB; the stress control bars have the voltage potential with the gradient change; and the voltage potential gradually decreases from the high-voltage winding leading-out foil to the low-voltage windings in a form of gradient.

9. The high-voltage isolation withstand planar transformer according to claim 8, wherein the plurality of voltage-balancing elements are welded to an outer layer of the multilayer PCB or embedded in an inner layer of the multilayer PCB.

10. The high-voltage isolation withstand planar transformer according to claim 8, wherein the high-voltage winding leading-out foil and the stress control bars are connected through buried vias, blind vias or through vias; and two terminals of an identical wire in the stress control bars connected to the voltage-balancing elements have an identical voltage potential.

11. The high-voltage isolation withstand planar transformer according to claim 8, wherein the plurality of voltage-balancing elements are resistors or capacitors.

12. A high-voltage insulation method of a high-voltage isolation withstand planar transformer, wherein the high-voltage isolation withstand planar transformer, comprises a low-voltage side connection terminal, low-voltage windings, high-voltage windings, a high-voltage winding leading-out foil, a high-voltage side connection terminal, a printed circuit board (PCB) insulating medium comprising an insulating medium of a printed circuit board (PCB) substrate and an insulating medium of a printed circuit board (PCB) prepreg, a magnetic core, a printed circuit board (PCB) stress grading unit, a voltage-balancing element group, and stress control bars, wherein the low-voltage side connection terminal is configured to connect the high-voltage isolation withstand planar transformer and an external low-voltage circuit; the low-voltage windings are connected to the low-voltage side connection terminal; the high-voltage windings are connected to the high-voltage side connection terminal through the high-voltage winding leading-out foil; the high-voltage side connection terminal is configured to connect the high-voltage isolation withstand planar transformer and an external high-voltage circuit; the PCB insulating medium is configured for high-voltage isolation between the low-voltage windings and the high-voltage windings; the magnetic core passes through an annular hollow part of the low-voltage windings and the high-voltage windings to form a closed magnetic circuit; the PCB stress grading unit is configured to control a distribution of an electric field around the high-voltage winding leading-out foil and reduce an electric field strength in air; and the voltage-balancing element group comprises a plurality of voltage-balancing elements and is configured to provide a voltage potential with a gradient change, wherein the plurality of voltage-balancing element are uniformly distributed through the stress control bars and sequentially connected in series between the high-voltage winding leading-out foil and the low-voltage windings; the high-voltage insulation method comprises:

step S10: determining a material and a thickness of the insulating medium of the PCB substrate according to a breakdown field strength, a dielectric constant, a loss factor, a thermal conductivity and a glass transition temperature (Tg) of the insulating medium of the PCB substrate; and determining a material and a thickness of the insulating medium of the PCB prepreg according to a gel time and a resin content;

step S20: obtaining a working condition of the high-voltage isolation withstand planar transformer, and determining, based on the working condition, maximum design electric field strengths of the PCB insulating medium and air as electric field strength thresholds;

step S30: determining a routing shape, a via hole form, a pad shape, a copper foil size and a winding stacking mode of the PCB according to a primary voltage, a secondary voltage, a rated power and an insulation withstand voltage of the high-voltage isolation withstand planar transformer, and determining a structure and a number of the stress control bars and the plurality of voltage-balancing elements in the PCB stress grading unit;

step S40: obtaining electric field strengths of the PCB insulating medium and the air through calculation, simulation or testing based on the thickness of the PCB insulating medium, the structure and the number of the plurality of voltage-balancing elements and the copper foil size of the PCB; and step S50: returning, when the electric field strengths are greater than the electric field strength thresholds, to step S10 for iterative design until the electric field strengths are less than the electric field strength thresholds, to obtain high-voltage insulation parameters of the high-voltage isolation withstand planar transformer.

13. The high-voltage insulation method according to claim 12, wherein the low-voltage windings and the high-voltage windings are inner-layer copper foils of a multilayer PCB; the low-voltage windings are distributed on upper and lower layers of the high-voltage windings; and a width of the low-voltage windings completely covers a width of the high-voltage windings.

14. The high-voltage insulation method according to claim 12, wherein the plurality of voltage-balancing elements are resistors or capacitors.

15. The high-voltage insulation method according to claim 12, wherein the PCB insulating medium comprises an FR-4 substrate with a high dielectric breakdown field strength and a prepreg.

16. The high-voltage insulation method according to claim 12, wherein the low-voltage windings have a multilayer structure, in which various layers are connected through buried vias, the high-voltage windings have a single-layer structure or have a multilayer structure, in which various layers are connected through buried vias.

17. The high-voltage insulation method according to claim 12, wherein the magnetic core is connected to a reference ground of the low-voltage windings through a conductor.

18. The high-voltage insulation method according to claim 12, wherein the plurality of voltage-balancing elements in the voltage-balancing element group are sequentially connected in series via the stress control bars; the stress control bars are a plurality of wires in a multilayer PCB; the stress control bars have the voltage potential with the gradient change; and the voltage potential gradually decreases from the high-voltage winding leading-out foil to the low-voltage windings in a form of gradient.

19. The high-voltage insulation method according to claim 18, wherein the plurality of voltage-balancing elements are welded to an outer layer of the multilayer PCB or embedded in an inner layer of the multilayer PCB.

20. The high-voltage insulation method according to claim 18, wherein the high-voltage winding leading-out foil and the stress control bars are connected through buried vias, blind vias or through vias; and two terminals of an identical wire in the stress control bars connected to the voltage-balancing elements have an identical voltage potential.

* * * * *